US008764137B2

(12) United States Patent
Fehre

(10) Patent No.: US 8,764,137 B2
(45) Date of Patent: Jul. 1, 2014

(54) DRAWER WHICH CAN BE DISMANTLED AND STACKED

(75) Inventor: Juergen Fehre, Boebingen an der Rems (DE)

(73) Assignee: Fehre Design GmbH, Boebingen (DE)

( * ) Notice: Subject to any disclaimer, the term of this patent is extended or adjusted under 35 U.S.C. 154(b) by 74 days.

(21) Appl. No.: 13/522,009

(22) PCT Filed: Dec. 23, 2010

(86) PCT No.: PCT/DE2010/001533

§ 371 (c)(1),
(2), (4) Date: Jul. 12, 2012

(87) PCT Pub. No.: WO2011/085710

PCT Pub. Date: Jul. 21, 2011

(65) Prior Publication Data

US 2012/0286637 A1 Nov. 15, 2012

(30) Foreign Application Priority Data

Jan. 13, 2010 (DE) ..... 10 2010 004 605

(51) Int. Cl.
*A47B 88/00* (2006.01)

(52) U.S. Cl.
USPC ..... 312/348.2; 312/330.1

(58) Field of Classification Search
USPC ..... 312/348.1–348.3, 330.1, 257.1, 312/265.5–265.6, 264–265, 240, 198, 312/107–108, 111
See application file for complete search history.

(56) References Cited

U.S. PATENT DOCUMENTS

| | | | | | |
|---|---|---|---|---|---|
| 835,508 | A | * | 11/1906 | Faust et al. | 312/108 |
| 1,989,849 | A | * | 2/1935 | Davies | 108/101 |
| 2,102,437 | A | * | 12/1937 | Richardson et al. | 312/304 |
| 3,288,301 | A | * | 11/1966 | Kent et al. | 211/41.17 |
| 3,926,491 | A | * | 12/1975 | Greer | 312/348.2 |
| 4,279,455 | A | * | 7/1981 | Santo | 312/348.2 |
| 4,285,559 | A | * | 8/1981 | Koch | 312/298 |
| 4,497,524 | A | * | 2/1985 | Levings et al. | 312/265 |
| 4,958,259 | A | * | 9/1990 | Berg et al. | 361/730 |
| 4,993,786 | A | * | 2/1991 | De Giulio | 312/298 |
| 5,037,165 | A | * | 8/1991 | Rapp et al. | 312/330.1 |
| 5,211,461 | A | * | 5/1993 | Teufel et al. | 312/334.4 |
| 5,281,020 | A | * | 1/1994 | Romick | 312/308 |
| 5,364,180 | A | | 11/1994 | Berger | |
| 6,027,192 | A | * | 2/2000 | Irace | 312/263 |

(Continued)

FOREIGN PATENT DOCUMENTS

| | | |
|---|---|---|
| DE | 74 36 307 U | 4/1975 |
| DE | 29 17 647 A1 | 11/1979 |

(Continued)

*Primary Examiner* — Darnell Jayne
*Assistant Examiner* — Ryan A Doyle
(74) *Attorney, Agent, or Firm* — R. Dabney Eastham

(57) ABSTRACT

The invention relates to a drawer for furniture, said drawer being dismantled, for assembly using practically no tools. The drawer consists of: two lateral wall elements, a front-and rear-face wall element that consist of a base profile, and a drawer base that consists of several identical base elements. The base element consists of a profile that has a tongue profile edge and a groove profile edge. Thus, any number of base elements can be mechanically joined together and then dismantled to form a surface. A drawer of equal size without a base surface may be connected to the drawer with a base surface.

3 Claims, 7 Drawing Sheets

(56) References Cited

U.S. PATENT DOCUMENTS

Figure 1:
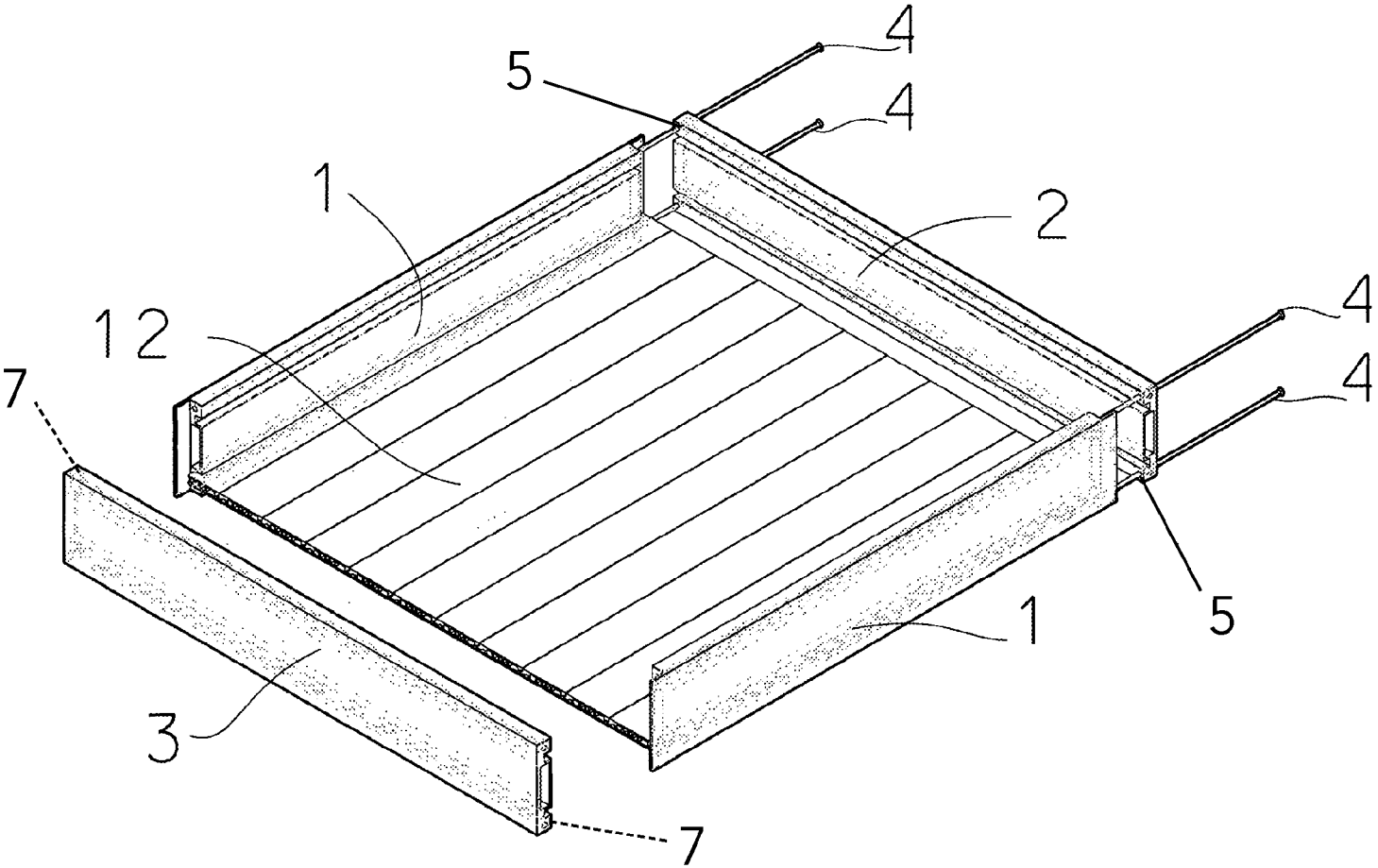

| | | | | |
|---|---|---|---|---|
| 6,312,068 | B1 * | 11/2001 | Benner et al. | 312/111 |
| 6,412,893 | B1 | 7/2002 | Müterthies et al. | |
| 2002/0171344 | A1 * | 11/2002 | Hollenstein | 312/348.3 |
| 2002/0185042 | A1 * | 12/2002 | Sukeva | 108/55.1 |
| 2003/0164665 | A1 * | 9/2003 | Guay et al. | 312/348.3 |
| 2003/0184198 | A1 * | 10/2003 | Bodingbauer | 312/348.3 |
| 2004/0144789 | A1 * | 7/2004 | Cheng | 220/529 |
| 2011/0068668 | A1 * | 3/2011 | Wilson | 312/265.5 |
| 2011/0242736 | A1 * | 10/2011 | Tsai | 361/679.01 |

FOREIGN PATENT DOCUMENTS

| | | | |
|---|---|---|---|
| DE | 87 05 187 | U1 | 7/1987 |
| DE | 90 01 485 | U1 | 4/1990 |
| DE | 92 08 609 | U1 | 10/1992 |
| DE | 42 00 581 | C1 | 7/1993 |
| DE | 297 07 568 | U1 | 7/1997 |
| DE | 10 2008 05707 | A1 | 5/2010 |
| EP | 1 084 655 | A1 | 3/2001 |
| EP | 1 364 598 | A1 | 11/2003 |
| FR | 2 204 957 | A5 | 5/1974 |
| GB | 2 030 068 | A | 4/1980 |

* cited by examiner

DRAWER WHICH CAN BE DISMANTLED AND STACKED

The invention relates to a drawer which can be dismounted or taken apart for nearly no-tools assembly, having at least two sidewall elements, a front wall element, a rear wall element, a bottom which can be dismounted, an area for guide elements, extendibility in height and in its internal layout, according to the introductory portion of patent claim 1.

PRIOR ART

Break-down drawers or drawers which can be dismounted have multiple fields of application both for kitchen, house, and office furniture, and in sales facilities and the like. It is known that these kinds of drawers when disassembled require little space for transport and can be advantageously assembled on site wherein more or less no-tools assembly work is provided. What is always used is a firm, non-sectional bottom requiring much space for transport, depending on the drawer's size.

The time required and the complexity in assembly confine the options in using these kinds of systems particularly if the drawer is complicated in design and consists of very many different components.

These kinds of solutions are described among others in DE 29 707 568, DE 4200581, DE 8705187 and DE 9001485.

Extensions in height, additional functions in the internal structure, and sectioning the drawer bottom to obtain single, identical elements cannot be realized therewith.

DEFINITION OF THE OBJECT

The invention relates to the object to develop a drawer of the type indicated initially which, given a nearly no-tools assembly, concurrently allows extensions in height and in the internal layout. The drawer is adapted to consist of a small number of basic profiles and only one type of multiple-use connecting element, and a bottom that can be dismounted to equal-sized elements. The components are provided to be structured such that they do not require classification to right and left, or top and bottom. That the space required when disassembled be as small as possible and thus transport costs and transport damage can be greatly reduced.

The object according to the invention is solved by the features of claim 1.

The two sidewall elements (1), the rear wall element (2) and the front wall element (3) preferably consist of an extruded hollow aluminum profile which is machined after being divided to specific lengths.

The hollow aluminum profile which is preferably extruded for all of the wall elements is provided on its inner face with a pair of identical recesses (8) located at the same distances from the upper edge (10) and the lower edge (11).

Two cylindrical chambers (6) are equally spaced from the upper edge (10) and from the lower edge (11) to receive the connecting element (4) in the preferably extruded hollow aluminum profile.

The cylindrical chambers (6) are marginally larger for the connecting element (4) to be pushed in resistance-free.

After specifying the length the two sidewall elements (1) are provided with equal-sized rabbets (9) at their two end faces. Thus each of the sidewall elements (1) can be equally employed for both sides.

The single bottom elements (12) preferably consist of an extruded hollow aluminum profile comprising a key profile edge (13) and a groove profile edge (14).

The key profile edge (13) of a bottom element (12) mechanically engages correspondingly in the groove profile edge (14) of the other of the bottom elements (12), forming a locked surface area.

This allows to mechanically join any desired number of bottom elements (12) to form a surface, and to break it down again.

Prior to assembly or mounting the bottom element pieces (12) are joined mechanically to obtain the desired drawer width and the combined surface thus formed is correspondingly inserted into one of the recesses (8).

The sidewall elements (1) are joined to the rear wall element (2) and the front wall elements (3) by way of the same connecting elements (4).

The connecting element (4) is guided through the counterbore (5) on the outside face in the rear wall element (2) and through the cylindrical chambers (6) in the sidewall element (1), and connected with the threaded bore (7) located in the front wall element (3).

The connecting element (4) consists of a threaded rod with an integral, countersunk screw head.

When the equal-sized side wall elements (1), the rear equal-sized wall element (2) and the front equal-sized wall element (3) with no bottom surface consisting of bottom element pieces (12), are once again connected with the connecting element (4) to form a frame structure, the same can be placed onto the drawer with a bottom surface consisting of single bottom elements (12).

To connect the two frame structures the connecting battens (15) are inserted into the two superposed recesses (8) at all of the four inner faces of the drawer in the following sequence.

First, the superposed side wall elements (1) are connected on their two sides with a connecting batten (15) of the length of the clear internal dimension of the drawer depth. Then the two superposed rear wall elements (2) and the two superposed front wall elements (3) are each connected with one connecting batten (15) of the length of the clear drawer width less the protrusions (19) of the connecting battens (15) of the side wall elements (1). In this way a drawer of a larger height is created.

Such superposed connecting of frames may be repeated as many times as desired until the intended drawer height is obtained.

The connecting batten (15) preferably consists of an extruded hollow aluminum profile which is correspondingly snugly fitted into the two recesses (8).

After sectioning to specific lengths the connecting batten (15) is provided with centered, evenly spaced bores (16) adapted to receive the transverse partition (17) and lengthwise partition (18).

When two or more frames are connected with the connecting battens (15) then various drawer inserts (20) can be placed on the protrusion (19) of the connecting batten (15) and they can be displaced either over the width or the depth, the objects stowed therein remain neatly grouped and access is possible at any time.

EXEMPLARY EMBODIMENT

The invention will be explained in detail by way of the drawings by the following exemplary embodiments.

The drawings show in detail what follows:

FIG. 1: Perspective exploded view of a drawer having two side wall elements (1), a rear wall element (2), a front wall element (3), four connecting elements (4), and a bottom surface consisting of bottom element pieces (12).

Figure 2:
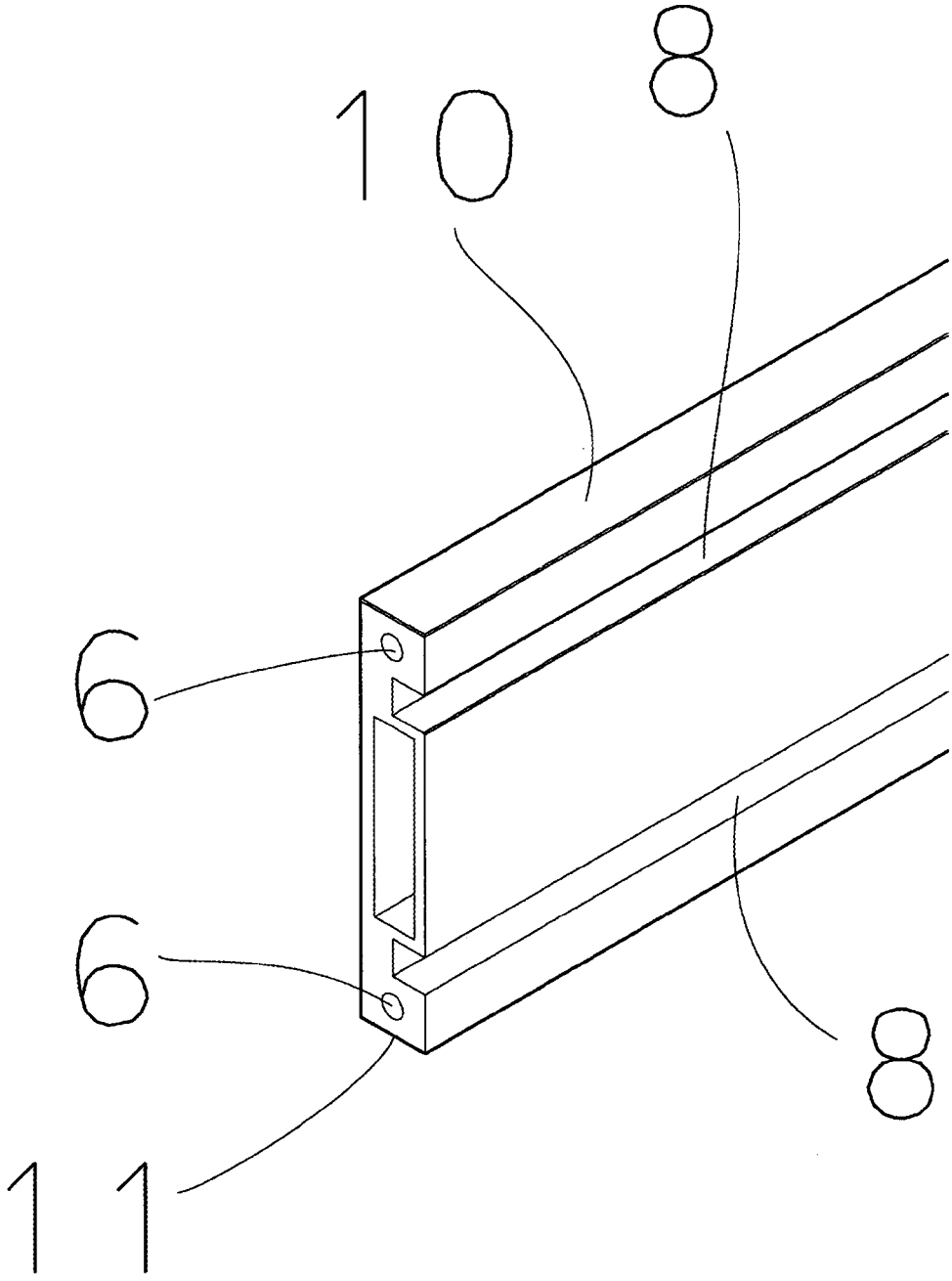

FIG. 2: Perspective view of the basic profile for the side wall element (1), rear wall element (2), front wall element (3)

with the pair of recesses (8) and the pair of cylindrical chambers (6), the upper edge (10) and the lower edge (11)

Figure 3:
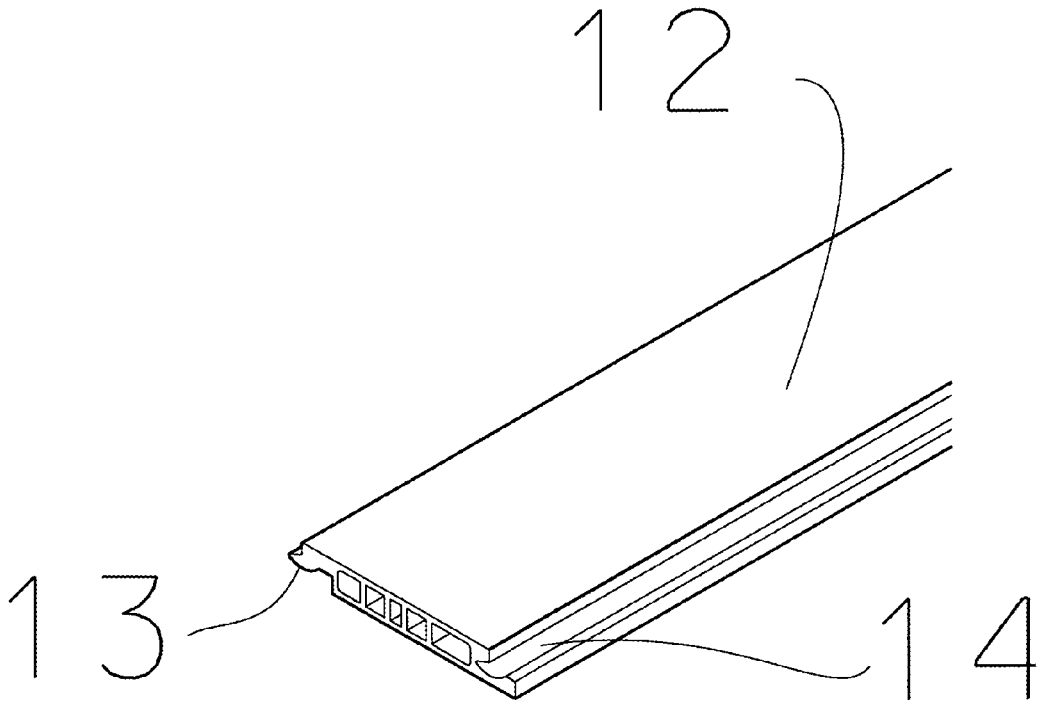

FIG. 3: Perspective view of the profile for the bottom element (12) with the key profile edge (13) and the groove profile edge (14)

Figure 4:
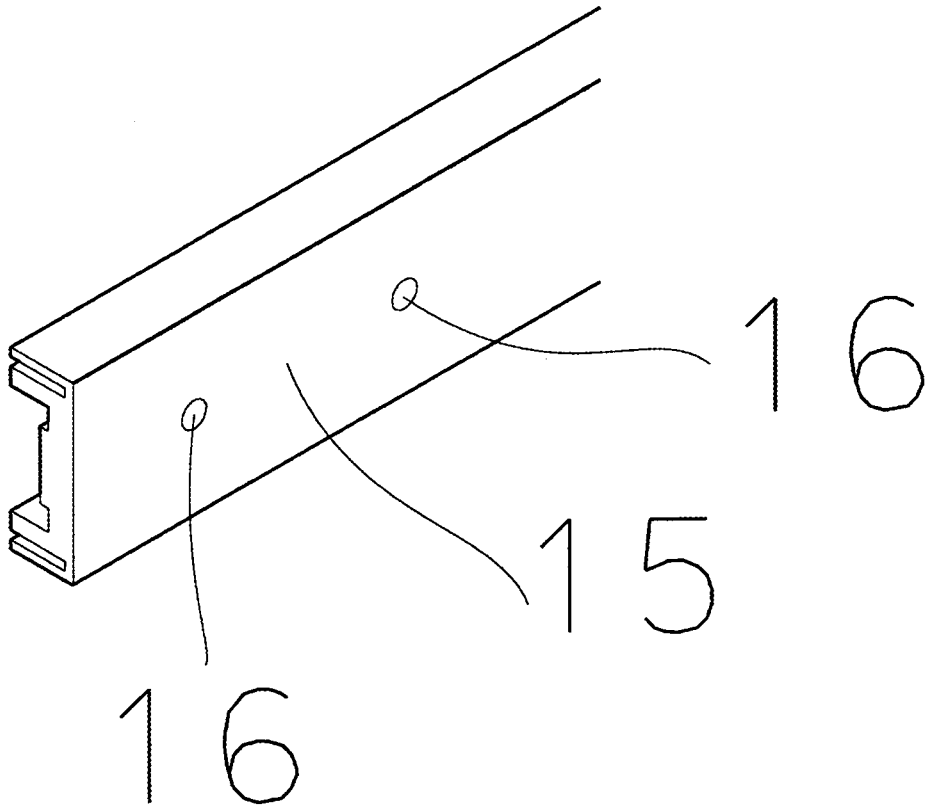

FIG. 4: Perspective view of the profile of the connecting batten (15) with bores (16)

Figure 5:
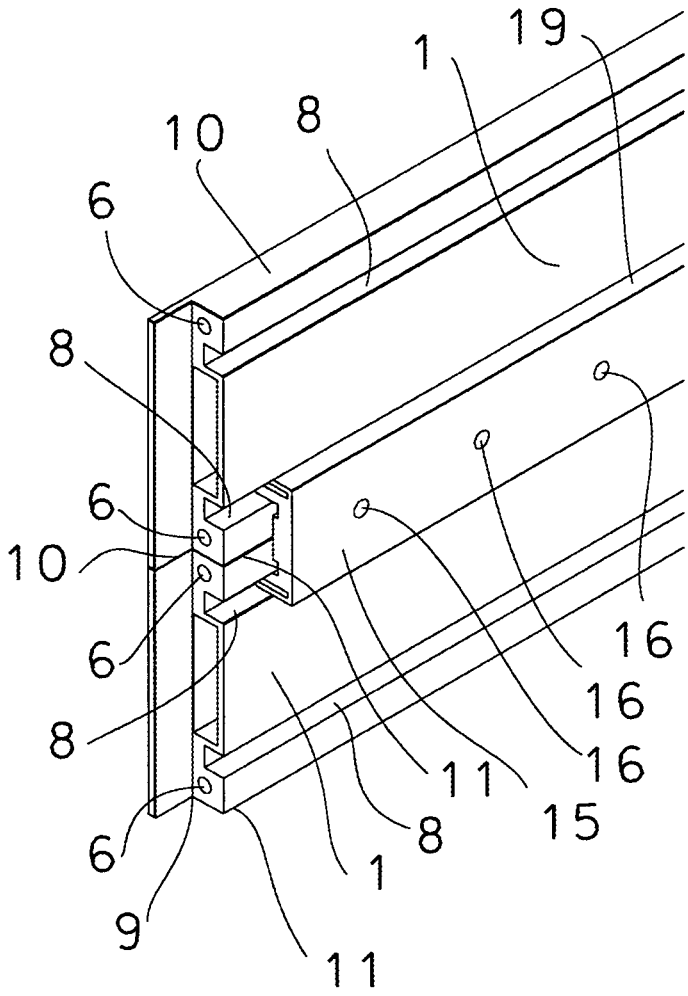

FIG. 5: Perspective sectional view of two superposed side wall elements (1), connected with the connecting batten (15)

Figure 6:
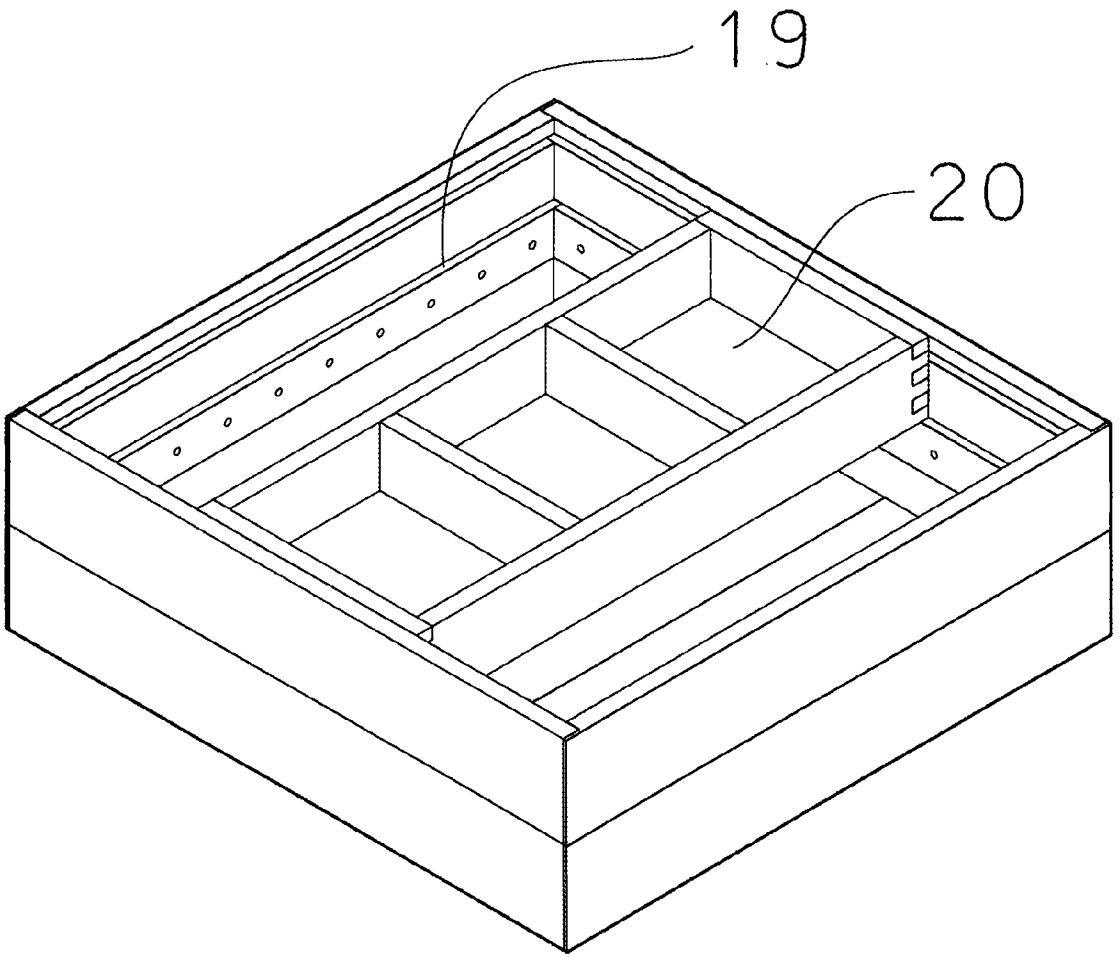

FIG. 6: Perspective view of an assembled drawer with the frame element in place and connected with connecting batten (15), cutlery insert (20) placed on the protrusion (19)

Figure 7:
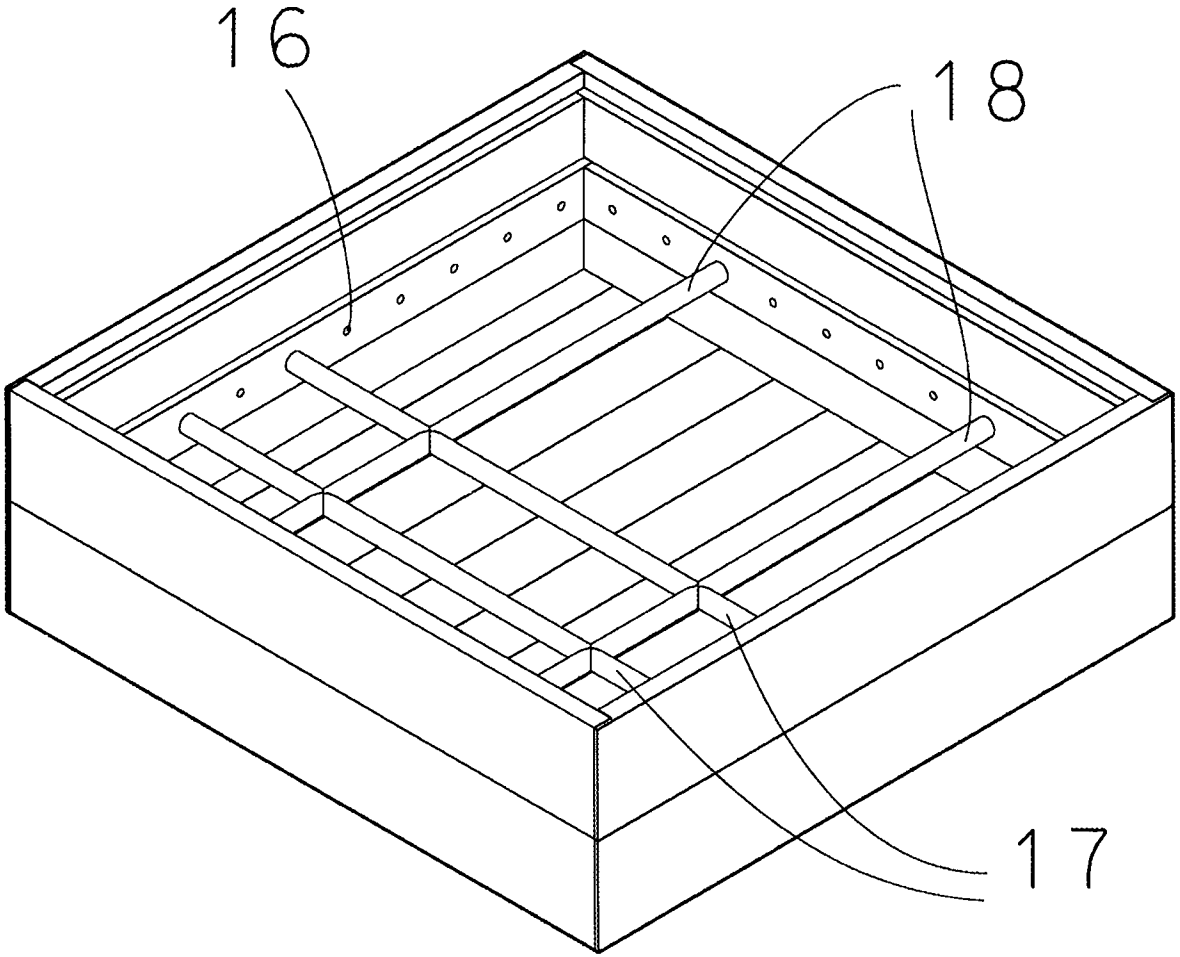

FIG. 7: Perspective view of an assembled drawer with the frame element in place and connected with connecting batten (15), the bores (16), the transverse partitions (17) and the lengthwise partitions (18)

LIST OF REFERENCE NUMERALS (1) side wall elements
(2) rear wall element
(3) front wall element
(4) connecting element
(5) counterbore
(6) cylindrical chamber
(7) threaded bore
(8) recess
(9) rabbet
(10) upper edge
(11) lower edge
(12) bottom elements
(13) key profile edge
(14) groove profile edge
(15) connecting batten
(16) bores
(17) transverse partition
(18) lengthwise partition
(19) protrusion
(20) cutlery insert and tray areas

EXAMPLE 1

The solution according to the invention will be exemplarily illustrated by way of assembling a drawer.

First the front wall element (3) of the drawer is placed onto a flat surface with the outside surface downwards.

Depending on the width of the drawer the bottom element pieces (12) are joined mechanically and the bottom surface thus created is correspondingly inserted into the recess (8) of the front wall element (3).

Both of the side wall elements (1) are now correspondingly placed on the front wall element (3) by one of their end-face rabbets (9) and with the recess (8) correspondingly placed onto the bottom surface consisting of multiple bottom elements (12).

Thereafter the rear wall element (2) is correspondingly placed in the other two end-face rabbets (9) of the side wall elements (1) and the recess (8) of the rear wall element (3).

Thereafter four connecting elements (4) are guided through the counterbores (5) on the outside in the rear wall element (2) and through the cylindrical chambers (6) in the two side wall elements (1) and fixedly connected with the threaded bores (7) located in the front wall element (3).

Thus the drawer is completely assembled in its lowest height.

Depending on which of different underfloor guide elements are used, different bores and or recesses are required on the bottom face of the drawer.

EXAMPLE 2

The solution according to the invention will be illustrated exemplarily by the extendibility of a drawer in height and in its internal layout.

Higher drawers can be assembled according to the same principle as it was shown for drawers in example 1.

To this end another frame structure without a bottom surface is placed on the assembled drawer consisting of two side wall elements (1), a rear wall element (2), a front wall element (3), a bottom surface consisting of multiple bottom elements (12) and connected by connecting elements (4).

To connect the two frame structures the connecting battens (15) are inserted into the two superposed recesses (8) on all of the four inner faces of the drawer in the following sequence.

First, the superposed side wall elements (1) are connected on their two sides with a connecting batten (15) of the length of the clear internal dimension of the drawer depth. Thereafter the two superposed rear wall elements (2) and the two superposed front wall elements (3) are connected with one connecting batten (15) each in the length of the clear drawer width less the protrusions (19) of the connecting batten (15) of the side wall elements (1).

Such superposed connecting of frames may be repeated as many times as desired until the intended drawer height is obtained.

When two or more frames are connected with the connecting battens (15) then various drawer inserts (20) can be placed on the protrusion (19) of the connecting battens (15) and they can be displaced either over the width or the depth, the objects beneath remain neatly stowed and access is possible at any time.

The invention claimed is:

1. A drawer, which can be dismounted, for nearly no-tools assembly, and having extendibility in height and extendibility in its internal layout, comprising:

a frame structure comprising two side wall elements, a front wall element, and a rear wall element, the frame structure having a height;

a plurality of bottom elements capable of being mounted onto the frame structure and which can be dismounted from the frame structure;

wherein the side wall elements each define a recess and a cylindrical chamber;

the rear wall element defines a recess and a pair of counterbores;

the front wall element defines a recess and a pair of threaded bores;

a pair of connecting elements, wherein the side wall elements are connected with the rear wall element and the front wall element by the connecting elements passing from the counterbores in the rear wall element, through the cylindrical chambers in the side wall elements, and to the threaded bores in the front wall element;

the bottom elements have a key profile edge and a groove profile edge wherein the key profile edge of a bottom element mechanically and correspondingly engages the groove profile edge of an adjacent bottom element whereby a combined base surface is manufactured;

wherein the recesses in the side wall elements, the front wall element, and the rear wall element are each shaped to receive a portion of the bottom elements whereby the plurality of bottom elements forming the combined base surface are held in the frame structure; and wherein an additional and equal-sized frame structure comprising two side wall elements, a rear wall element, and a front wall element connected with connecting elements is placed onto the frame structure of the drawer for extending the height of the drawer and is connected to the frame structure of the drawer with connecting battens and each of the connecting battens defines a protrusion and the protrusions comprise an additional guiding plane in the drawer whereby the additional guiding plane may be employed to receive cutlery inserts or trays.

2. The drawer according to claim 1 further comprising a cutlery insert supported by the protrusions.

3. The drawer according to claim 1 further comprising a tray supported by the protrusions.

* * * * *